US007969402B2

(12) United States Patent
Lee

(10) Patent No.: US 7,969,402 B2
(45) Date of Patent: Jun. 28, 2011

(54) GATE DRIVING CIRCUIT AND DISPLAY DEVICE HAVING THE SAME

(75) Inventor: Hyun Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 805 days.

(21) Appl. No.: 11/521,287

(22) Filed: Sep. 14, 2006

(65) Prior Publication Data

US 2007/0085811 A1 Apr. 19, 2007

(30) Foreign Application Priority Data

Oct. 18, 2005 (KR) ..... 10-2005-0098144

(51) Int. Cl.
*G09G 3/36* (2006.01)

(52) U.S. Cl. ..... 345/100

(58) Field of Classification Search ..... 345/100, 345/98, 99

See application file for complete search history.

(56) References Cited

U.S. PATENT DOCUMENTS

| | | | | |
|---|---|---|---|---|
| 5,926,156 | A * | 7/1999 | Katoh et al. | 345/55 |
| 6,819,311 | B2 * | 11/2004 | Nose et al. | 345/100 |
| 2003/0090614 | A1 * | 5/2003 | Kim et al. | 349/149 |
| 2005/0001805 | A1 * | 1/2005 | Jeon et al. | 345/92 |
| 2005/0078076 | A1 * | 4/2005 | Kim et al. | 345/98 |
| 2006/0145964 | A1 * | 7/2006 | Park et al. | 345/76 |
| 2006/0267911 | A1 * | 11/2006 | Jang | 345/100 |

* cited by examiner

*Primary Examiner* — Chanh Nguyen
*Assistant Examiner* — Robert M Stone
(74) *Attorney, Agent, or Firm* — F. Chau & Associates LLC

(57) ABSTRACT

A gate driving circuit and a display device having the same, in which the gate lines can be divided into p groups using p shift registers and p-time gate lines can be driven using a signal shifted by 1/p, wherein p is an arbitrary natural number of three or more. Accordingly, since a number of gate lines can be driven using the plurality of shift registers, high-resolution display devices can be manufactured at a low cost.

11 Claims, 5 Drawing Sheets

GATE DRIVING CIRCUIT AND DISPLAY DEVICE HAVING THE SAME

CROSS-REFERENCE TO RELATED APPLICATION

This application claims priority from Korean Patent Application number 10-2005-0098144, filed Oct. 18, 2005 whose contents are incorporated herein in its entirety by reference.

BACKGROUND OF THE INVENTION

1. Technical Field

The present disclosure relates to a gate driving circuit and a display device having the same. More particularly, the present disclosure relates to a gate driving circuit for driving a number of gate lines using a plurality of shift registers each having a plurality of stages, and an display device having the gate driving circuit.

2. Discussion of the Related Art

A liquid crystal display (LCD) is a device in which an electric field is applied to a liquid crystal substance with an anisotropic dielectric constant, which has been injected between two substrates, and the intensity of the electric field is adjusted to control an amount of light transmitted onto the substrate such that a desired image can be displayed thereon.

A plurality of gate lines parallel to one another and a plurality of data lines crossing the gate lines are formed on the substrate of such an LCD in a state where the gate and data lines are insulated from each other, and each pixel is defined in a region surrounded by these gate and data lines. A thin film transistor (hereinafter, referred to as "TFT") and a pixel electrode are formed at a portion where the respective gate and data lines cross each other.

The LCD includes a gate driving circuit for driving the gate lines and a source driving circuit for driving the data lines. If the gate driving circuit applies a predetermined voltage to the gate line, the data line and the pixel electrode connected respectively to both ends of the TFT are electrically connected with each other. At this time, the source driving circuit applies a predetermined data voltage to the pixel electrode through the data line such that the LCD can be driven.

The gate driving circuit can be driven using a shift register.

FIG. 1 is a block diagram illustrating a shift register constituting a gate driving circuit of an LCD panel according to the prior art.

The shift register comprises a plurality of stages 21, each of which includes a first output terminal GOUT for driving each of the gate lines $G_1$ to $G_5$, a second output terminal SOUT, an input terminal IN, a control terminal CT, a clock input terminal CK, a ground voltage terminal VSS, and a driving voltage terminal VDD.

The stage 21 is connected to each of the gate lines and the second output terminal SOUT is connected both to the input terminal IN of the next stage and the control terminal CT of the previous stage such that the stages are dependently connected to one another to thereby drive all the gate lines.

In order to smoothly display a moving image on the LCD, the gate line should be driven at least 60 times per second. However, since the shift register so configured has a low operating speed, it is difficult to drive up to 400 gate lines as typically required.

SUMMARY OF THE INVENTION

Exemplary embodiments of the present invention are provided to solve the aforementioned problems. Accordingly, an exemplary embodiment of the present invention provides a gate driving circuit for driving a number of gate lines using a plurality of shift registers, each having a plurality of stages, and an display device having the gate driving circuit.

According to an exemplary embodiment of the present invention, there is provided a gate driving circuit for outputting driving signals to a plurality of gate lines, which comprises p shift registers for driving gate lines divided into p groups, respectively (wherein p is an arbitrary natural number of three or more). Each of the shift registers includes a plurality of stages dependently connected to one another, and a start signal is input to an input terminal of a first stage of each shift register and an output signal from a specific stage is connected to an input terminal of the next stage of each shift register, whereby the plurality of gate lines are sequentially driven by means of the output signals of the respective stages.

The p start signals used in the p shift registers are shifted from one another by 1/p.

Each of the stages may comprise an input terminal for receiving a stage driving signal output from any one stage of the previous stages; a clock terminal for receiving any one clock signal of a plurality of clock signals with phases different from one another; a control terminal for receiving a stage driving signal output from any one stage of the next stages; a first output terminal for outputting a gate driving signal.

Each of the stages may further comprise a second output terminal for outputting stage driving signal to any one stages of the next stages.

In this exemplary embodiment, p is a natural number of four and the gate lines are divided into four groups in an order of 4n-3, 4n-2, 4n-1 and 4n (wherein n is a natural number of one or more).

According to an exemplary embodiment of the present invention, there is provided a display device, which comprises an display device including a plurality of gate lines, a plurality of data lines crossing the gage lines, and a switching element and a pixel electrode formed between the gate and data lines; a gate driving circuit for selecting a gate line and allowing a switching element connected to the selected gate line to be switched on; and a source driving circuit for driving a data line connected to the pixel electrode by means of the switching on of the switching element in accordance with input image data. The gate driving circuit comprises p shift registers for driving gate lines divided into p groups, respectively (wherein p is an arbitrary natural number of three or more), each of the shift registers includes a plurality of stages dependently connected to one another, and a start signal is input to an input terminal of a first stage of each shift register and an output signal from a specific stage is connected to an input terminal of the next stage of each shift register, whereby the plurality of gate lines are sequentially driven by means of the output signals of the respective stages.

The p start signals used in the p shift registers are shifted from one another by 1/p.

Each of the stages may comprise an input terminal for receiving a stage driving signal output from any one stage of the previous stages; a clock terminal for receiving any one clock signal of a plurality of clock signals with phases different from one another; a control terminal for receiving a stage driving signal output from any one stage of the next stages; a first output terminal for outputting a gate driving signal.

Each of the stages may further comprise a second output terminal for outputting stage driving signal to any one stage of the next stages.

In this exemplary embodiment, p is a natural number of four and the gate lines are divided into four groups in an order of 4n-3, 4n-2, 4n-1 and 4n (wherein n is a natural number of one or more).

The source driving circuit applies a data voltage for the last period among p periods obtained by dividing a period when a gate signal is applied to the gate line by p.

BRIEF DESCRIPTION OF THE DRAWINGS

Exemplary embodiments of the present invention will be understood in more detail from the following description taken in conjunction with the accompanying drawings, in which.

DETAILED DESCRIPTION OF EXEMPLARY EMBODIMENTS

Figure 1:
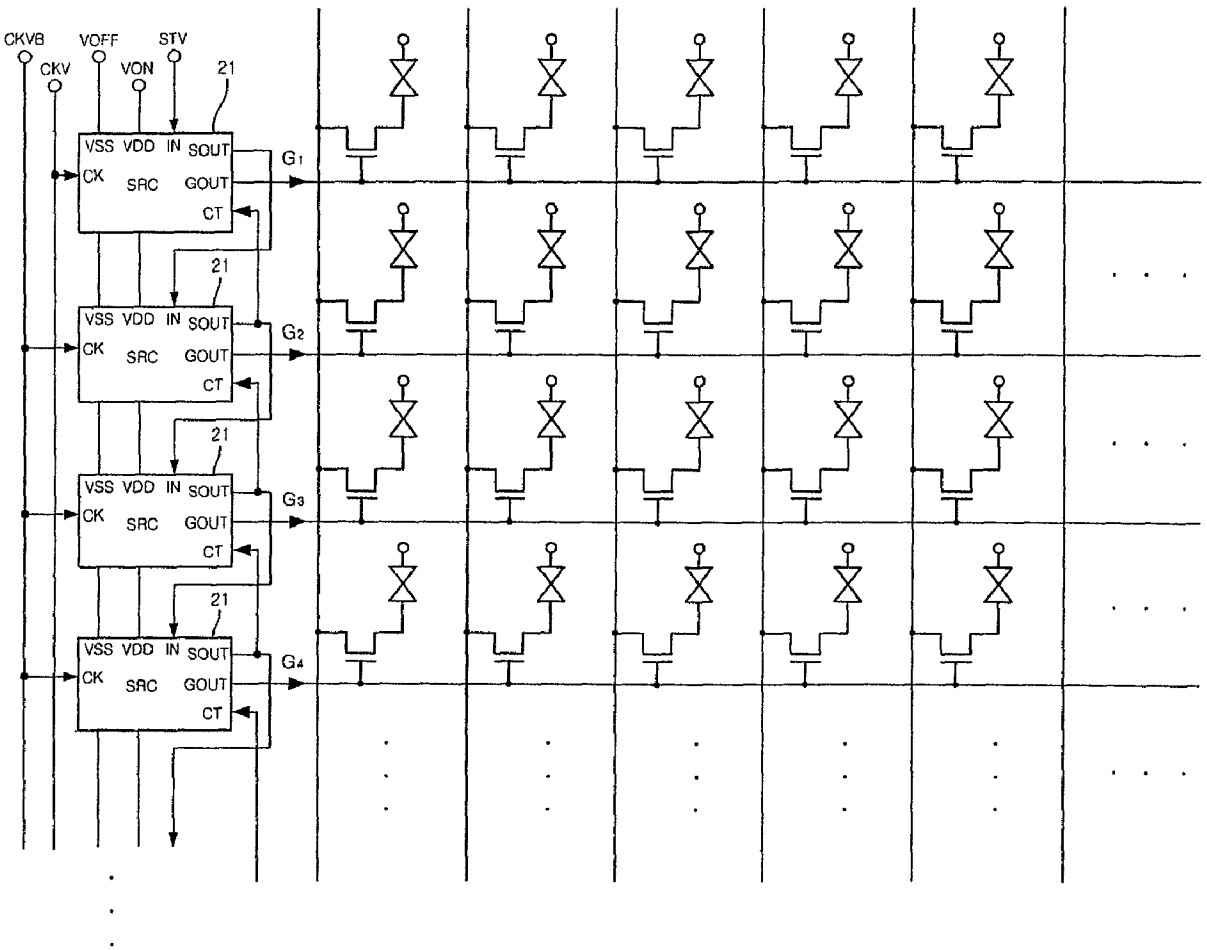
FIG.1 ( PRIOR ART )
FIG. 1 is a block diagram illustrating a shift register constituting a gate driving circuit of a liquid crystal display (LCD) panel according to the prior art.
Figure 2:
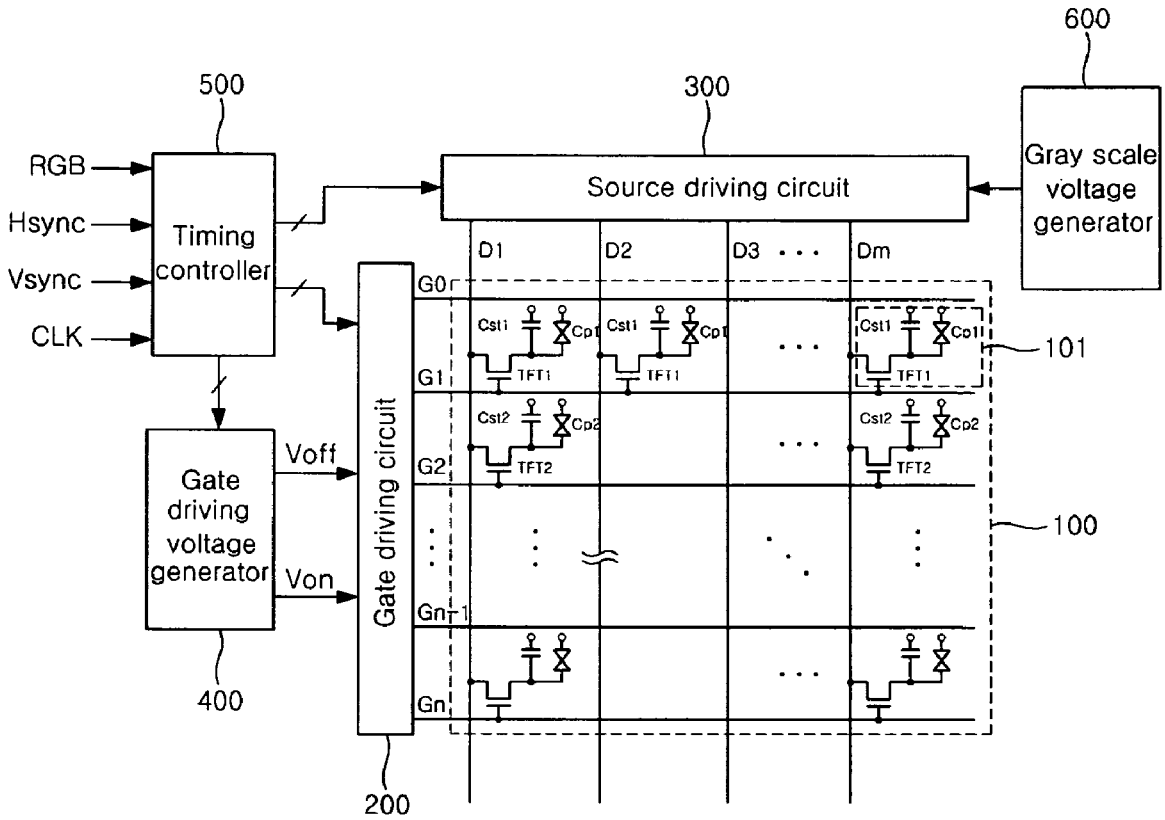
FIG. 2 is a schematic view of an LCD according to an exemplary embodiment of the present invention.

FIG. 2 is a schematic view of a liquid crystal display (LCD) according to an exemplary embodiment of the present invention.

As shown in FIG. 2, the LCD according to the exemplary embodiment of the present invention comprises an LCD panel 100, a gate driving circuit 200, a source driving circuit 300, a driving voltage generator 400, a timing controller 500 and a gray scale voltage generator 600.

The LCD panel 100 comprises a plurality of gate lines G1, G2, . . . , and G4*n* formed in a row direction and a plurality of data lines D1, D2, . . . , Dm formed in a column direction. A pixel is defined in a region surrounded by the gate and data lines. The pixel comprises a thin film transistor (hereinafter, referred to as "TFT") connected to the gate and data lines and a pixel electrode. Here, n and m are natural numbers of one or more.

If the gate driving circuit 200 applies a predetermined voltage to the gate line, the data line and the pixel electrode connected respectively to both ends of the TFT are electrically connected with each other. At this time, the source driving circuit 300 applies a predetermined data voltage to the pixel electrode through the data line such that the LCD panel 100 can be driven.

The timing controller 500 receives a red (R), green (G), blue (B) data signal, a vertical synchronization signal Vsync serving as a frame sorting signal, a horizontal synchronization signal Hsync, and a main clock signal CLK from a graphic controller (not shown) outside an LCD module to generate and output a digital signal for driving the gate and source driving circuits 200 and 300.

Timing signals output from the timing controller 500 to the gate driving circuit 200 include control signals such as a vertical start signal for instructing the start of application of a gate signal to the gate line, a gate clock signal for sequentially applying the gate signal to each of the gate lines and a gate-on signal for allowing an output of the gate driving circuit 200 to be enabled.

Timing signals output from the timing controller 500 to the source driving circuit 300 include control signals such as a horizontal start signal for instructing the start of driving of an RGB data signal received from the graphic controller, a signal for instructing the application of a data signal converted into an analog signal within the source driving circuit 300, and a horizontal clock signal for shifting data within the source driving circuit 300.

The driving voltage generator 400 generates gate-on and gate-off voltages Von and Voff, each of which is used as a gate signal, and a driving reference voltage A Vdd that serves as a reference when generating a gray scale voltage and a common voltage Vcom. The gate-on and gate-off voltages Von and Voff are output to the gate driving circuit 200, and the driving reference voltage A Vdd is output to a common voltage generator (not shown) and the gray scale voltage generator 600.

At this time, the gate driving circuit 200 receives the gate clock signal and the vertical start signal from the timing controller 500 and the gate driving voltages Von and Voff from the driving voltage generator 400 and controls a relevant TFT, such that a data voltage is transmitted to each relevant pixel on the LCD panel 100.

The driving circuit 200 according to the exemplary embodiment of the present invention applies the gate-on voltage Von sequentially to the gate lines $G_1$, $G_2$, . . . , and $G_{4n}$ using first to fourth shift registers each having a plurality of stages, so as to allow the TFTs of the LCD panel to be turned on or off.

The first shift register drives the (4n-3)th gate lines G1, G5, . . . , and G4n-3; the second shift register drives the (4n-2)th gate lines G2, G6, . . . , and G4n-2; the third shift register drives the (4n-1)th gate lines G3, G7, . . . , and G4n-1; and the fourth shift register drives the (4n)th gate lines G4, G8, . . . , and G4n. That is, the gate driving circuit 200 drives the gate lines classified into four groups G1, G2, . . . , and G4n using the four relevant shift registers.

The gate driving circuit 200 is formed at an edge region of the LCD panel 100, and more specifically, is formed at both sides of a non-display region where pixels are not formed on the LCD panel 100. In this exemplary embodiment the two shift registers of the four shift registers are arranged at one side and the other two shift registers thereof are arranged at the other side. Further, the gate driving circuit 200 may be formed together when the pixels of the LCD panels are formed.

The gray scale voltage generator 600 generates a gray scale voltage in accordance with the bit number of RGB data received from the graphic controller and transmits the generated gray scale voltage to the source driving circuit 300.

The source driving circuit 300 applies a data voltage to the data lines D1, D2, . . . , and Dm in accordance with the signal output from the timing controller 500.

Figure 3:
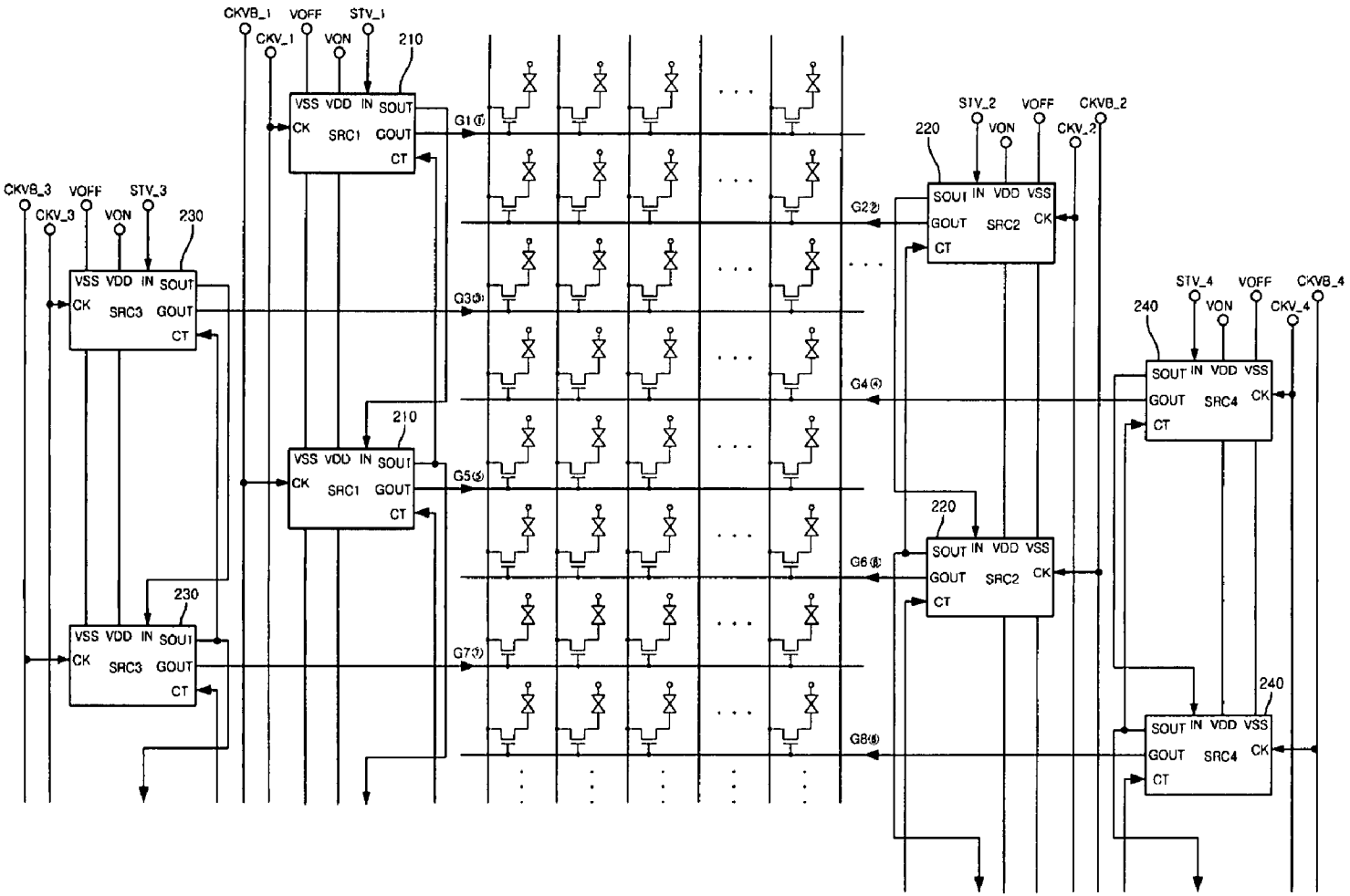
FIG. 3 is block diagram illustrating shift registers constituting a driving circuit of an LCD panel according to an exemplary embodiment of the present invention.
Figure 4:
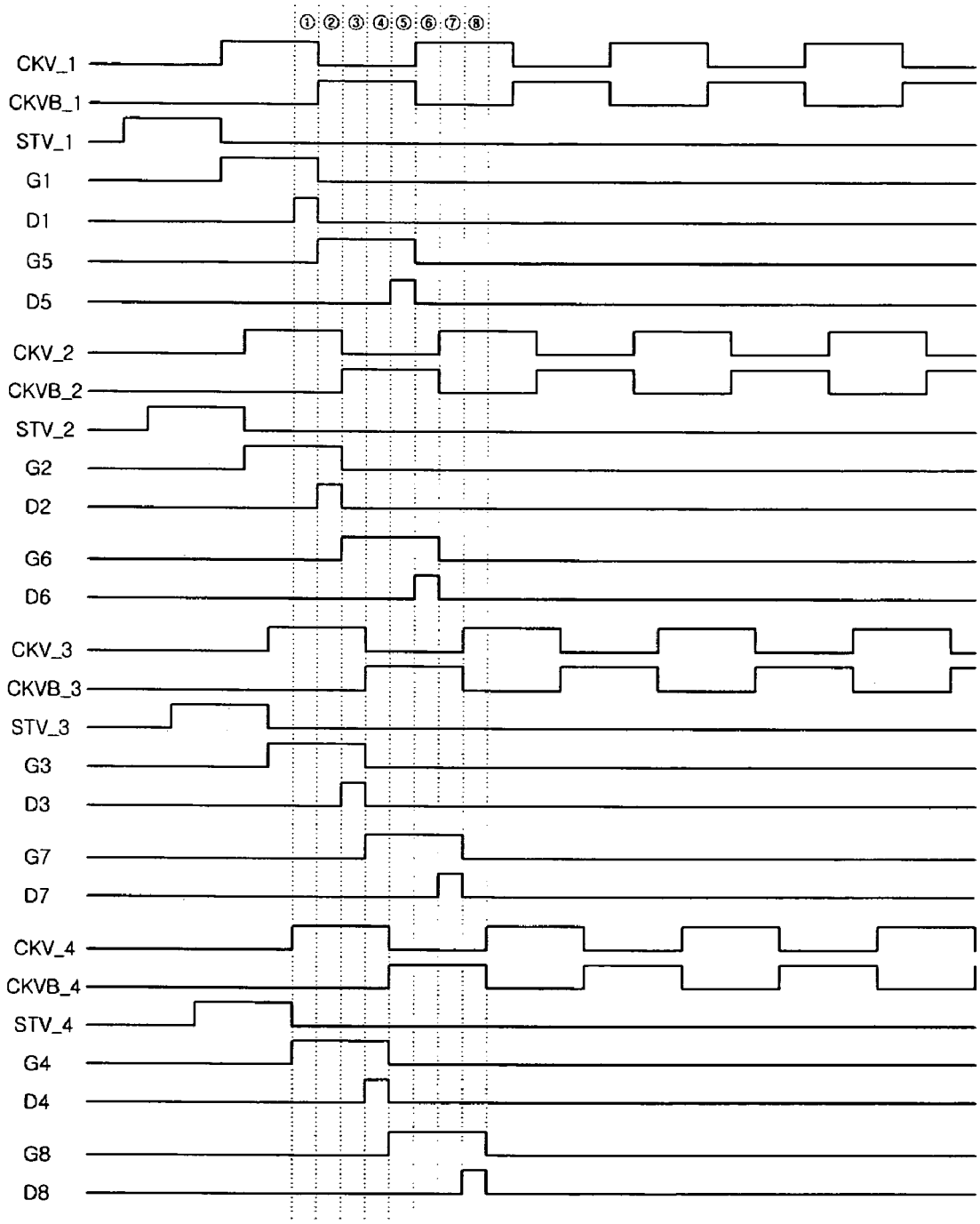
FIG. 4 is a waveform diagram of a voltage applied to the shift registers and gate lines shown in FIG. 3.

FIG. 3 is block diagram illustrating first to fourth shift registers constituting the gate driving circuit of the LCD panel shown in FIG. 2, and FIG. 4 is a waveform diagram of a voltage applied to the shift registers shown in FIG. 3.

Referring to FIG. 3, the gate driving circuit 200 of FIG. 2 comprises a first shift register with a plurality of first stages 210 (SCR1) dependently connected to one another; a second shift register with a plurality of second stages 220 (SCR2) dependently connected to one another; a third shift register with a plurality of third stages 230 (SCR3) dependently connected to one another; and a fourth shift register with a plurality of fourth stages 240 (SCR4) dependently connected to one another.

The first shift register is connected to the (4n-3)th gate lines G1, G5, . . . , and G4n-3; the second shift register is connected to the (4n-2)th gate lines G2, G6, . . . , and G4n-2; the third shift register is connected to the (4n-1)th gate lines G3, G7, . . . , and G4n-1; and the fourth shift register is connected to the (4n)th gate lines G4, G8, . . . , and G4n.

Each of the stages of the shift registers comprises an input terminal IN, a first output terminal GOUT, a second output terminal SOUT, a control terminal CT, a clock input terminal CK, a ground voltage terminal VSS, and a driving voltage terminal VDD.

A start signal is input to the input terminal IN of the first stage included in the shift register. Further, the second output terminal SOUT of each stage is connected to the input terminal IN of the next stage of the relevant shift register and to the control terminal of the previous stage thereof, such that the stages are dependently connected to one another.

A first start signal STV_1 is input to the input terminal IN of the first stage in the first shift register. The first output terminal GOUT of each of the stages is connected to each of the gate lines G1, G5, . . . , and G4n-3 corresponding thereto. A first clock signal CKV_1 is provided to the odd-numbered stages and a first inverted clock signal CKVB_1 is provided to the even-numbered stages. At this time, the first clock signal CKV_1 and the first inverted clock signal CKVB_1 have phases opposite to each other.

A second start signal STV_2 is input to the input terminal IN of the first stage in the second shift register. The first output terminal GOUT of each of the stages is connected to each of the gate lines G2, G6, . . . , and G4n-2 corresponding thereto. A second clock signal CKV_2 is provided to the odd-numbered stages and a second inverted clock signal CKVB_2 is provided to the even-numbered stages. At this time, the second clock signal CKV_2 and the second inverted clock signal CKVB_2 have phases opposite to each other.

A third start signal STV_3 is input to the input terminal IN of the first stage in the third shift register. The first output terminal GOUT of each of the stages is connected to each of the gate lines G3, G7, . . . , and G4n-1 corresponding thereto. A third clock signal CKV_3 is provided to the odd-numbered stages and a third inverted clock signal CKVB_3 is provided to the even-numbered stages. At this time, the third clock signal CKV_3 and the third inverted clock signal CKVB_3 have phases opposite to each other.

A fourth start signal STV_4 is input to the input terminal IN of the first stage in the fourth shift register. The first output terminal GOUT of each of the stages is connected to each of the gate lines G4, G8, . . . , and G4n corresponding thereto. A fourth clock signal CKV_4 is provided to the odd-numbered stages and a fourth inverted clock signal CKVB_4 is provided to the even-numbered stages. At this time, the fourth clock signal CKV_4 and the fourth inverted clock signal CKVB_4 have phases opposite to each other.

In the shift register, an output signal of the next stage is input to the control terminal CT of the current stage as a control signal. At this time, the control signal input to the control terminal CT serves to change the output signal of the relevant stage down to a low state. In such a way, the output signals of the first to fourth shift registers are sequentially set in a high state such that the gate lines G1 to G4*n* can be sequentially driven.

The operation of the gate driving circuit according to the exemplary embodiment of the present invention will be described in detail with reference to FIG. 4.

Referring to FIG. 4, the second to fourth start signals used respectively in the second to fourth shift registers according to the embodiment of the present invention are signals that are sequentially shifted by a ¼ length with respect to the first start signal. That is, the second start signal is a signal in which the first start signal is shifted by a ¼ length; the third start signal is a signal in which the second start signal is shifted by a ¼ length; and the fourth start signal is a signal in which the third start signal is shifted by a ¼ length.

Similarly to the first to fourth start signals, the first to fourth clock signals and the first to fourth inverted clock signals have such a relationship that the second to fourth clock signals and inverted clock signals are sequentially shifted by a ¼ length with respect to the first clock signal and the inverted clock signal, respectively. Thus, the gate signals output from the second to fourth shift registers are also sequentially shifted by a ¼ length with respect to the gate signal output from the first shift register.

That is, the gate driving circuit 200 according to the exemplary embodiment of the present invention sequentially shifts gate signals output to the first to eighth lines G1 to G8 by a ¼ length with respect to the signals output to the first gate line G1.

A period ① will be discussed with reference to FIG. 4. In the period ① shown in FIG. 4, a data voltage D1 for driving pixels corresponding to the first gate line G1 is output to the data lines D1 to Dm. At this time, since gate signals are output to the first to fourth gate lines G1 to G4, the data voltage D1 is charged in the pixels of four lines corresponding to the first to fourth gate lines G1 to G4. Thus, the pixels of the four lines corresponding to the first to fourth gate lines G1 to G4 have the same data voltages as one another.

Next, a period ② will be discussed. Since the gate signal of the first gate line G1 is cut off within the period ②, the data voltage D1 is maintained as it is in the relevant pixels corresponding to first gate line G1.

Further, in the period ②, a data voltage D2 for driving pixels corresponding to the second gate line G2 is output to the data lines D1 to Dm. At this time, since gate signals are output to the second to fifth gate lines G2 to G5, the data voltage D2 is charged in the pixels of four lines corresponding to the second to fifth gate lines G2 to G5. Thus, the pixels of the four lines corresponding to the second to fifth gate lines G2 to G5 have the same data voltages as one another.

Next, a period ③ will be discussed. Since the gate signal of the second gate line G2 is cut off within the period ③, the data voltage D2 is maintained as it is in the relevant pixels corresponding to second gate line G2.

Further, in the period ③, a data voltage D3 for driving pixels corresponding to the third gate line G3 is output to the data lines D1 to Dm. At this time, since gate signals are output to the third to sixth gate lines G3 to G6, the data voltage D3 is charged in the pixels of four lines corresponding to the third to sixth gate lines G3 to G6. Thus, the pixels of the four lines corresponding to the third to sixth gate lines G3 to G6 have the same data voltages as one another.

In such a way, data voltages D4 to D8 are applied respectively in periods ④ to ⑧, the data voltages D4 to D8 are charged respectively in pixels corresponding to the fourth to eighth gate lines G4 to G8.

That is, the LCD according to the exemplary embodiment of the present invention is configured in such a manner that a period in which a gate signal is applied to the gate lines G1 to G4*n* is equally divided into four and a data voltage is applied in the final period of the divided periods so that the data voltage can be charged in pixels corresponding relevant gate lines.

If such a gate driving circuit is used, it can drive gate lines four times more than those of a gate driving circuit in which only one shift register is used.

Although it has been described that four shift registers are used in the gate driving circuit according to the exemplary embodiment of the present invention, gate lines may be divided into p groups using p shift registers, and p-time gate lines may be driven using signals shifted by 1/p (wherein p is an arbitrary natural number of three or more).

Hereinafter, an internal circuit of a stage constituting the shift register will be described. Since a variety of circuits performing the same operation exist in the aforementioned shift register, however, one circuit frequently used in the circuits will be described by way of example.

Figure 5:
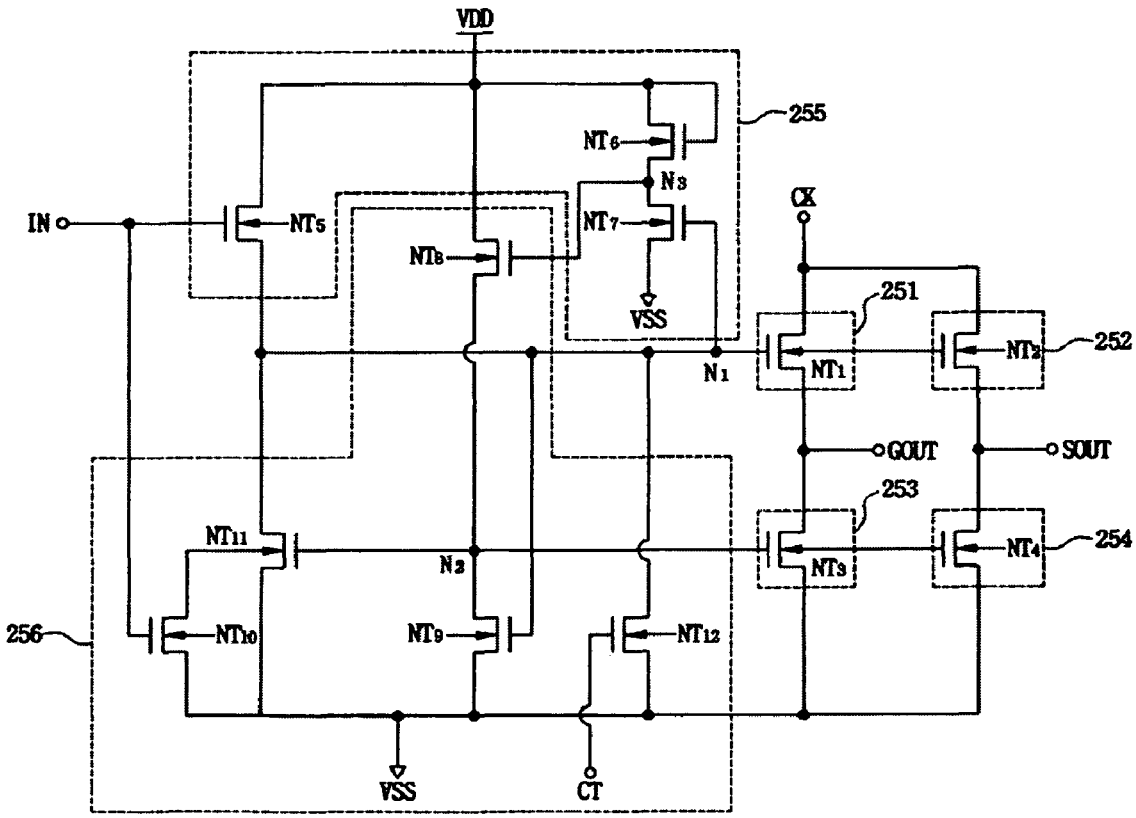
FIG. 5 is a circuit diagram showing an internal circuit of each stage in the shift register shown in FIG. 3.

FIG. 5 is a circuit diagram showing an internal circuit of each stage included in the shift register.

Referring to FIG. 5, each of the stages comprises a first pull-up unit 251, a second pull-up unit 252, a first pull-down unit 253, a second pull-down unit 254, a pull-up driving unit 255, and a pull-down driving unit 256.

The first pull-up unit 251 outputs a signal provided to the clock terminal CK to the first output terminal GOUT as a gate driving signal. The second pull-up unit 252 outputs a signal provided to the clock terminal CK to the second output terminal SOUT as a stage driving signal.

The first pull-up unit 251 comprises a first transistor NT1 in which the gate, source and drain electrodes are connected to a first node N1, the clock terminal CK and the first output terminal GOUT, respectively. The second pull-up unit 252 comprises a second transistor NT2 in which gate, source and drain electrodes are connected to the first node N1, the clock terminal CK and the second output terminal SOUT, respectively.

The first pull-down unit 253 is turned on to discharge a gate driving signal output to the first output terminal GOUT after the first pull-up unit 251 has been turned off, and the second pull-down unit 254 is turned on to discharge a stage driving signal output to the second output terminal SOUT.

The first pull-down unit 253 comprises a third transistor NT3 in which the gate, source and drain electrodes are connected to a second node N2, the first output terminal GOUT and the ground voltage terminal VSS, respectively. The second pull-down unit 252 comprises a fourth transistor NT4 in which gate, source and drain electrodes are connected to the second node N2, the second output terminal SOUT and the ground voltage terminal VSS, respectively.

The pull-up driving unit 255 comprises fifth to seventh transistors NT5, NT6 and NT7 to turn on the first and second pull-up units 251 and 252.

The fifth transistor NT5 is configured in such a manner that the gate, drain and source electrodes are connected to the input terminal IN, the driving voltage terminal VDD and the first node N1, respectively. The sixth transistor NT6 is configured in such a manner that the gate and drain electrodes are connected to the driving voltage terminal VDD and a source electrode is connected to a third node N3. The seventh transistor NT7 is configured in such a manner that the gate, drain and source electrodes are connected to the first node N1, the third node N3 and the ground voltage terminal VSS, respectively.

The pull-down driving unit 256 comprises eighth to twelfth transistors NT8, NT9, NT10, NT11 and NT12 to turn on the first and second pull-down units 253 and 254, while turning off the first and second pull-up units 251 and 252.

The eighth transistor NT8 is configured in such a manner that the gate, drain and source electrodes are connected to the third node N3, the driving voltage terminal VDD and the second node N2, respectively. The ninth transistor NT9 is configured in such a manner that the gate, drain and source electrodes are connected to the first node N1, the second node N2 and the ground voltage terminal VSS, respectively. The tenth transistor NT10 is configured in such a manner that the gate, drain and source electrodes are connected to the input terminal IN, the second node N2 and the ground voltage terminal VSS, respectively.

The eleventh transistor NT11 is configured in such a manner that the gate, drain and source electrodes are connected to the second node N2, the first node N1 and the ground voltage terminal VSS, respectively. The twelfth transistor NT12 is configured in such a manner that the gate, drain and source electrodes are connected to the control terminal CT, the first node N1 and the ground voltage terminal VSS, respectively.

If a stage driving signal output from the second output terminal SOUT of the previous stage is provided to the input terminal IN, the fifth transistor NT5 is turned on such that the electric potential of the first node N1 gradually rises. As the electric potential of the first node N1 rises, the first and second transistors NT1 and NT2 are turned on such that the gate and stage driving signals are output to the first and second output terminals GOUT and SOUT, respectively.

Meanwhile, as the electric potential of the first node N1 rises in a state where the sixth transistor is always maintained in a turn-on state, the electric potential of the third node N3 falls if the seventh transistor NT7 is turned on.

As the electric potential of the third node N3 falls, the eighth transistor NT8 is maintained in a turn-off state. Thus, the driving voltage is not provided to the second node N2. Further, the ninth transistor NT9 is turned on to maintain the electric potential of the second node N2 at the ground voltage when the electric potential of the first node N1 rises and, thus, the third and fourth transistors NT3 and NT4 are turned off.

Thereafter, if a stage driving signal output from the second output terminal SOUT of the next stage through the control terminal CT is provided, the twelfth transistor NT12 is turned on to discharge the electric potential of the first node N1 to the ground voltage terminal VSS. As the electric potential of the first node N1 falls, the seventh and ninth transistors NT7 and NT9 are turned off.

Therefore, the electric potential of the second node N2 gradually rises and, thus, the third and fourth transistors NT3 and NT4 are turned on to discharge the gate driving signal output from the first and second output terminals GOUT and SOUT to the ground voltage terminal VSS.

At this time, the tenth and eleventh transistors are turned on as the electric potential of the second node N2 rises. Thus, the electric potential of the first node N1 is rapidly discharged. When such a process is repeated, each of the stages outputs gate and stage driving signals in which a high state is maintained for a predetermined period of time.

As described above, a gate driving circuit according to the exemplary embodiment of the present invention can divide gate lines into p groups using p shift registers and drive p-time gate lines using a signal shifted by 1/p (wherein p is an arbitrary natural number of three or more). Accordingly, since a number of gate lines can be driven using a plurality of shift registers, high-resolution LCDs can be manufactured at a low cost.

The previous embodiments of the present invention illustrate mainly the liquid crystal display device, but display devices are not limited to the aforementioned liquid crystal display device. The present invention can be applied to other display devices such as an OLED using a principle that a light emitting element made of as a semi-conductive organic material or conjugated polymer is inserted between two electrodes to which voltage is applied to flow electric current through the light emitting element to thereby emit light.

While the present invention has been described in connection with the exemplary embodiment, it will be understood by those skilled in the art that various modifications and changes can be made thereto without departing from the spirit and scope of the invention defined by the appended claims.

What is claimed is:

1. A gate driving circuit for outputting driving signals to a plurality of gate lines, the circuit comprising:

p shift registers for driving gate lines divided into p groups, respectively, wherein the plurality of gate lines comprises first to p-th gate lines sequentially deposited and corresponding to first to p-th shift registers, respectively, wherein each of the p shift registers includes a plurality of stages dependently connected to one another, and each of p start signals is sequentially input to an input terminal of a first stage of each of the first to p-th shift registers, respectively, and an output signal from a selected stage is connected to an input terminal of the next stage of each of the p shift registers, whereby the first to p-th gate lines are sequentially driven by means of the output signals of first to p-th stages corresponding to the first to p-th shift registers, respectively, wherein each of the p start signals of a high state are partially overlapped, wherein the p start signals used in the p shift registers are shifted from one another by 1/p, and wherein p is a natural number of four, and the gate lines are divided into four groups in an order of 4n-3, 4n-2, 4n-1 and 4n, wherein n is a natural number of one or more.

2. The gate driving circuit as claimed in claim 1, wherein each of the plurality of stages comprises:

an input terminal for receiving a stage driving signal output from any one stage of the previous stages;

a clock terminal for receiving any one clock signal of a plurality of clock signals with phases different from one another;

a control terminal for receiving a stage driving signal output from any one stage of the next stages;

a first output terminal for outputting a gate driving signal.

3. The gate driving circuit as claimed in claim 2 further comprising a second output terminal for outputting the stage driving signal to any one stage of the next stages.

4. The gate driving circuit as claimed in claim 1, wherein each of the plurality of stages comprises:

an input terminal for receiving a stage driving signal output from any one stage of the previous stages;

a clock terminal for receiving any one clock signal of a plurality of clock signals with phases different from one another;

a control terminal for receiving a stage driving signal output from any one stage of the next stages;

a first output terminal for outputting a gate driving signal.

5. The gate driving circuit as claimed in claim 4 further comprising a second output terminal for outputting the stage driving signal to any one stage of the next stages.

6. A display device, comprising:

a display device including a plurality of gate lines, a plurality of data lines crossing the gate lines, and a switching element and a pixel electrode formed between the gate and data lines;

a gate driving circuit for selecting a gate line and allowing a switching element connected to the selected gate line to be switched on; and a source driving circuit for driving a data line connected to the pixel electrode by means of the switching on of the switching element in accordance with input image data, wherein the gate driving circuit includes p shift registers for driving the gate lines divided into p groups, respectively, wherein the plurality of gate lines comprises first to p-th gate lines sequentially deposited and corresponding to first to p-th shift registers, respectively, each of the shift registers includes a plurality of stages dependently connected to one another, and each of first to p-th start signals is sequentially input to an input terminal of a first stage of each of the first to p-th shift registers, respectively, and an output signal from a selected stage is connected to an input terminal of the next stage of each shift register, whereby the first to p-th gate lines are sequentially driven by the output signals of first to p-th stages, corresponding to the first to p-th shift registers, respectively, and wherein each of the p start signals of a high state are partially overlapped, wherein the p start signals used in the p shift registers are shifted from one another by 1/p, and wherein p is a natural number of four, and the plurality of gate lines are divided into four groups in an order of 4n-3, 4n-2, 4n-1 and 4n, wherein n is a natural number of one or more.

7. The display device as claimed in claim 6, wherein each of the plurality of stages comprises:

an input terminal for receiving a stage driving signal output from any one stage of the previous stages;

a clock terminal for receiving any one clock signal of a plurality of clock signals with phases different from one another;

a control terminal for receiving a stage driving signal output from any one stage of the next stages;

a first output terminal for outputting a gate driving signal.

8. The display device as claimed in claim 7 further comprising a second output terminal for outputting the stage driving signal to any one stage of the next stages.

9. The display device as claimed in claim 6, wherein each of the plurality of stages comprises:

an input terminal for receiving a stage driving signal output from any one stage of the previous stages;

a clock terminal for receiving any one clock signal of a plurality of clock signals with phases different from one another;

a control terminal for receiving a stage driving signal output from any one stage of the next stages;

a first output terminal for outputting a gate driving signal.

10. The display device as claimed in claim 9 further comprising a second output terminal for outputting the stage driving signal to any one stage of the next stages.

11. The display device as claimed in claim 6, wherein the source driving circuit applies a data voltage for the last period among p periods obtained by dividing a period when the gate driving signal is applied to the gate line by p.

* * * * *